US006042116A

United States Patent [19]

Underwood

[11] Patent Number: 6,042,116

[45] Date of Patent: Mar. 28, 2000

[54] FAIR, THREE-SIDED DIE

[76] Inventor: Matthew Underwood, 14811 S. Camp Williams Rd., Bluffdale, Utah 84065

[21] Appl. No.: 09/074,636

[22] Filed: May 7, 1998

[51] Int. Cl.[7] ..... A63F 9/04

[52] U.S. Cl. ..... 273/146; D21/372; D21/373

[58] Field of Search ..... 273/146, 143 A; D21/372, 373

[56] References Cited

U.S. PATENT DOCUMENTS

D. 233,898 12/1974 Warren ..... D21/373
D. 235,073 5/1975 Warren ..... D21/373

FOREIGN PATENT DOCUMENTS 2594705 8/1987 France ..... 273/146

*Primary Examiner*—Benjamin H. Layno
*Attorney, Agent, or Firm*—Seed IP Law Group, PLLC; David V. Carlson

[57] ABSTRACT

A fair three-sided die having three edges and three sides. A first edge has an identical symbol on either side of the first edge representing the number one. A second edge has another identical symbol on either side of the second edge representing the number two. A third edge has another identical symbol on either side of the third edge representing the number three.

7 Claims, 6 Drawing Sheets

Front

Top

Bottom

End

Front

Top

Bottom

End

Front

Top

Bottom

End

FAIR, THREE-SIDED DIE

TECHNICAL FIELD

This invention is in the field of gaming dice, and particularly relates to a fair, three-sided die.

BACKGROUND OF THE INVENTION

Six-sided die are well-known for various games and playing boards. In some games, it is desirable to have a pair of dice, or a single die which has fewer than six sides.

SUMMARY OF THE INVENTION

According to principles of the present invention, there is provided a die having three sides. The die is balanced equally on all sides and has uniform density throughout. This results in a die that is fair, namely the numbers 1, 2 and 3 will be randomly generated on each throw of the die. The die is preferably formed from a single piece of material, such as wood, plastic, metal or other suitable material. It has three sides, each side being generally in the shape of an ellipse and coming together with a point at each end.

The die includes three edges, where the respective sides meet. Each edge of the die is preferably marked with a respective number, either 1, 2 or 3. The numbers may be roman numeral, Arabic numbers, dots or other symbol showing the number of the edge.

The number that the dice rolls is shown at the topmost edge. Namely, the dice will always roll with one side downmost, against the surface. Opposite the side which is down, will be an edge which is up. The top edge represents the number which has been rolled. Accordingly, the number is marked near the respective edges.

DETAILED DESCRIPTION OF THE INVENTION

Figure 1:
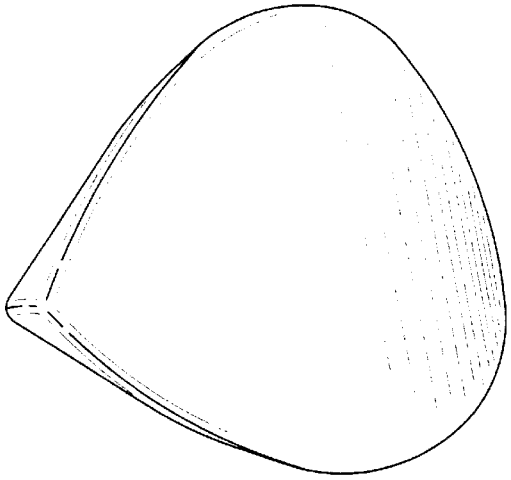
FIG. 1 is an isometric view of the inventive die.
Figure 2:
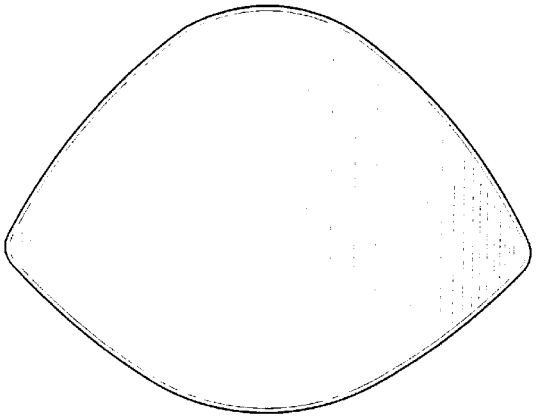
FIG. 2 is a front view of the inventive die.
Figure 3:
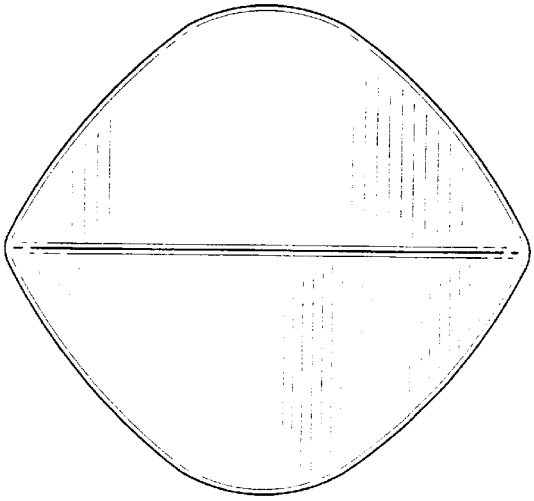
FIG. 3 is a top view of the inventive die.
Figure 4:
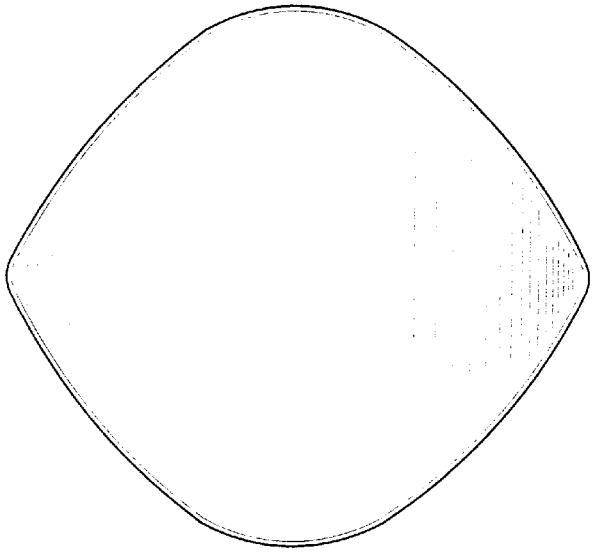
FIG. 4 is a bottom view of the inventive die.
Figure 5:
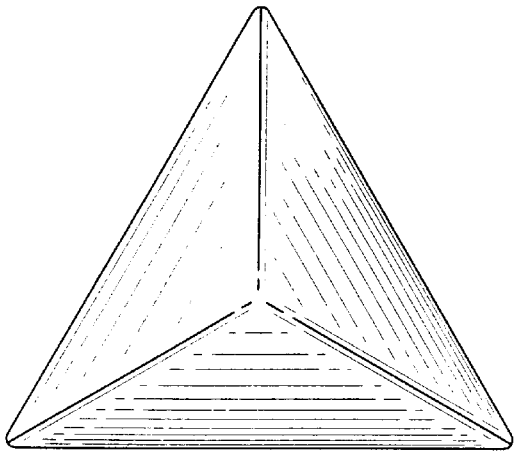
FIG. 5 is an end view of the inventive die.
Figure 6:
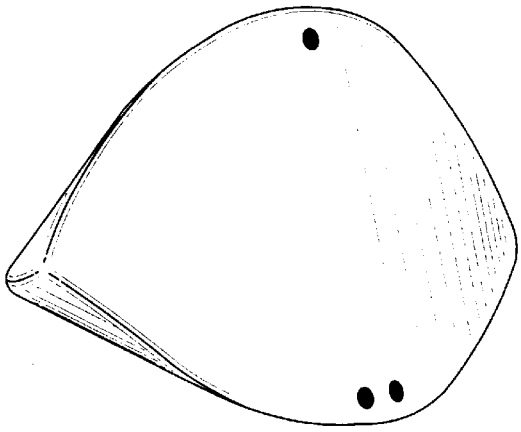
FIG. 6 is an isometric view of the alternative embodiment of the inventive die.
Figure 7:
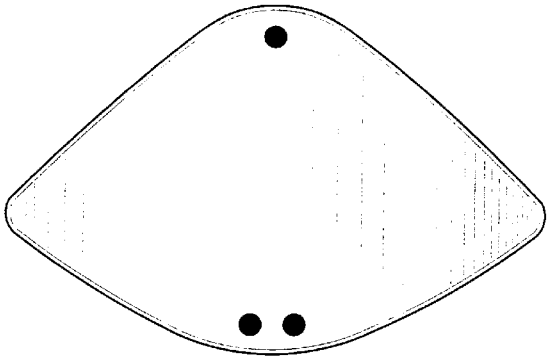
FIG. 7 is a front view of an alternative embodiment of the inventive die, with a slightly elongated shape.
Figure 8:
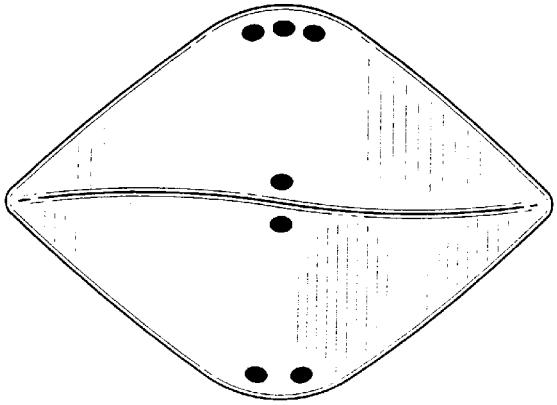
FIG. 8 is a top view of alternative embodiment of FIG. 6.
Figure 9:
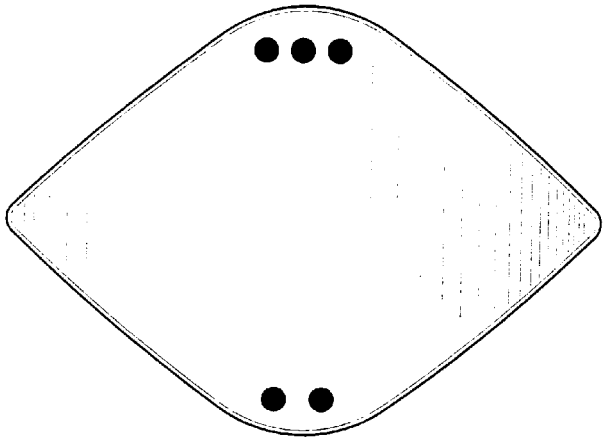
FIG. 9 is a bottom view of the alternative embodiment of FIG. 6.
Figure 10:
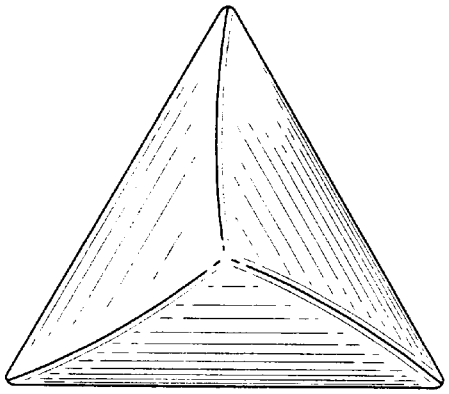
FIG. 10 is an end view of the alternative embodiment of FIG. 6.
Figure 11:
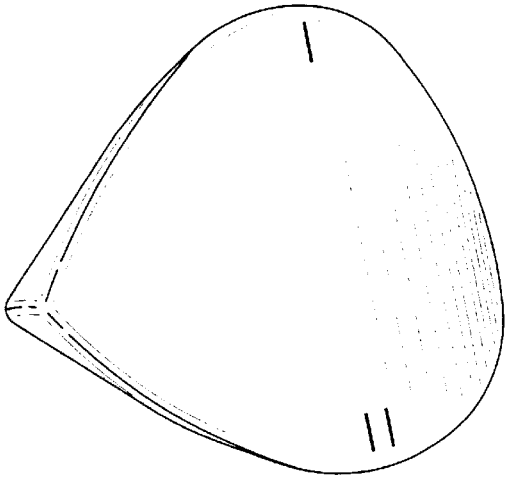
FIG. 11 is an isometric view of the die of FIG. 1, having roman numerals marked thereon indicating the number edge for the die.
Figure 12:
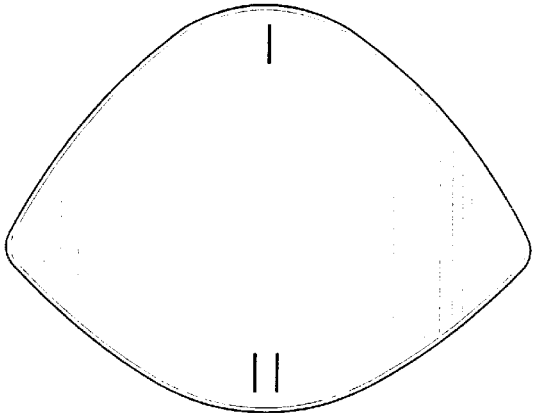
FIG. 12 is a front view of the embodiment of FIG. 11.
Figure 13:
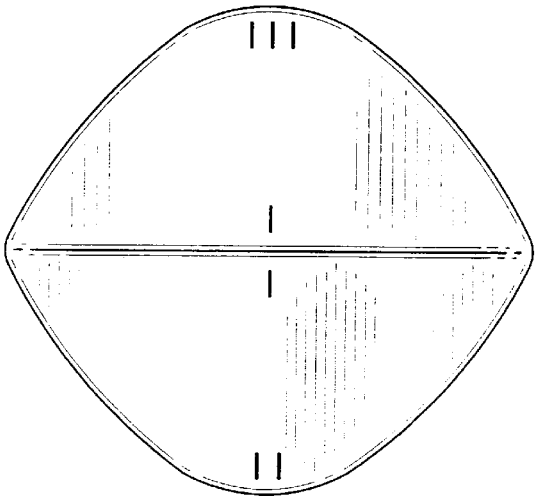
FIG. 13 is a top view of the embodiment of FIG. 11.
Figure 14:
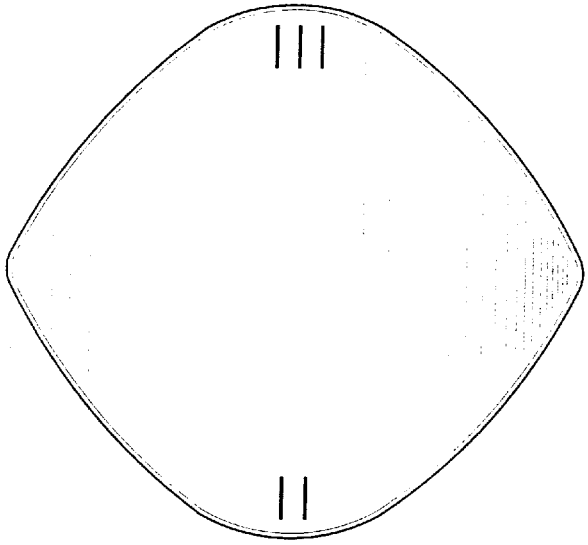
FIG. 14 is a bottom view of the embodiment of FIG. 11.
Figure 15:
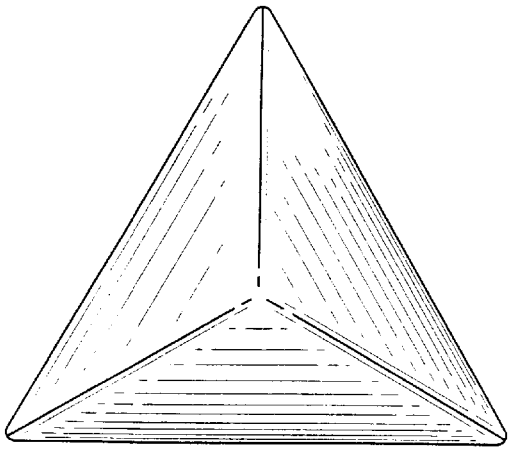
FIG. 15 is an end view of the embodiment of FIG. 11.

As shown in FIGS. 7 and 11, the number of the die is indicated with the appropriate marking such circles at the respective edges. One edge has a single dot on either side of the edge indicating it represents the number one. Another edge has a two on either side of the edge indicating it represents a two and the third edge has three dots along either side of its edge indicating that it represents a three. When the die is rolled, at least one edge will always be upmost. A particular edge which is the highest, or the upmost is the edge which has been rolled. Since the numerical value for that edge is clearly represented on both sides, all players of the game will instantly and quickly recognize the number which has been rolled. Further, the number which has been rolled an easily be viewed from many angles and from all sides of the table.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. A die comprising:

a first side;

a second side;

a third side;

a first edge between the first and second sides;

a second edge between the first and third sides;

a third edge between the second and third sides;

a first numerical mark on the first side, adjacent the first edge;

an additional first numerical mark on the second side, adjacent the first edge;

a second numerical mark on the first side adjacent the second edge;

an additional second numerical mark on the third side adjacent the second edge;

a third numerical mark on the second side, adjacent the third edge; and an additional third numerical mark on the third side, adjacent the third edge.

2. The die according to claim 1 which is equally weighted on all sides.

3. The die according to claim 1 in which the die is generally an ellipsoid in shape, having two generally pointed ends and an ellipsoid shape between the generally pointed ends.

4. The die according to claim 1 wherein the respective numerical markings are provided in duplicate adjacent each respective edge and are positioned on the respective side such that each can be individually viewed.

5. The die according to claim 1 wherein each of said first, second and third edge has a curvature as it extends from a first end to a second end for enhancing the of the roll of the die.

6. A three-sided die comprising:

a first end having a generally rounded, pointed shape;

a second end having a generally rounded, pointed shape;

three side surfaces which extend from the first end to the second end;

three edges that extend from the first end to the second end, the edges being positioned between adjacent sides, the ends, sides and edges together providing a generally ellipsoid shape having rounded features for a smooth, easy rolling die;

a first symbol being placed at two locations on the die, the two positions being adjacent a first edge, one being on a first and the other position being on a second side of the die;

a second symbol being placed at two different locations on the die, the two positions being adjacent a second edge of the die; one being on the first and the other being on a third side of the die; and a third symbol being placed at two different locations on the die, the two positions being adjacent a third edge of the die, one being on the second and the other being on the third side.

7. The die according to claim 6 in which the first, second and third edges are curved extending from the first end to the second end to enhance the smooth rolling of the die.

* * * * *